United States Patent [19]

Hada et al.

[11] 4,100,461

[45] Jul. 11, 1978

[54] DRIVING CIRCUIT FOR A GAS DISCHARGE DISPLAY PANEL

[75] Inventors: Hiroshi Hada; Tsutomu Hirayama, both of Tokyo, Japan

[73] Assignee: Nippon Electric Co., Ltd., Tokyo, Japan

[21] Appl. No.: 703,058

[22] Filed: Jul. 6, 1976

[30] Foreign Application Priority Data

Jul. 7, 1975 [JP] Japan ..... 50-83269
May 18, 1976 [JP] Japan ..... 51-62970[U]

[51] Int. Cl.[2] ..... H01J 1/53; H05B 37/00

[52] U.S. Cl. ..... 315/169 TV; 340/324 M; 315/169 R

[58] Field of Search ..... 315/169 TV, 169 R; 340/324 M

[56] References Cited

U.S. PATENT DOCUMENTS 3,967,157 6/1976 Hada et al. ..... 315/169 TV
3,987,337 10/1976 Nishida et al. ..... 315/169 TV

FOREIGN PATENT DOCUMENTS 2,256,528 6/1973 Fed. Rep. of Germany ..... 315/169 TV

*Primary Examiner*—Nelson Moskowitz

[57] ABSTRACT

A circuit for driving one electrode group of a gas discharge display panel includes a plurality of PNP transistors and NPN transistors. The emitter electrodes of the PNP transistors are connected to a positive voltage source and the emitter electrodes of the NPN transistors are connected to ground. Diode means are connected between the collector electrodes of the PNP transistors and those of the NPN transistors across matrix points formed at the intersections of a first plurality of conductors connected respectively to the collector electrodes of the PNP transistors and a second plurality of conductors connected respectively to the collector electrodes of the NPN transistors. The individual electrodes of one electrode group of the gas discharge panel are connected to the diode means. The circuit also includes a first plurality of diodes and a second plurality of diodes connected to the first plurality of conductors and the second plurality of conductors, respectively.

4 Claims, 2 Drawing Figures

DRIVING CIRCUIT FOR A GAS DISCHARGE DISPLAY PANEL

BACKGROUND OF THE INVENTION

This invention relates to electronic displays and, more specifically, to a circuit for driving a gas discharge display panel which may be an external electrode gas discharge display panel known in general as a plasma display panel.

A gas discharge display panel comprises opposed electrode groups arranged on either side of a gas discharge space, which may either be a continuous space filled with an ionizable gas or a plurality of like spaces, called discharge cells. Layers of an electrically insulating material may be provided on the opposed surfaces of the electrodes as in a plasma display panel. The electrode groups may either be groups of so-called matrix electrodes or a combination of a first group of segmented electrodes and a second group of the opposite electrode or electrodes.

A conventional driving circuit of the type described includes at least one switching transistor for each of the electrodes of the display panel. The switching transistors must withstand a relatively high voltage, such as 140 volts. Also, a logic circuit has been necessary in order to supply pulses to each switching transistor. It has therefore been unavoidable that such a prior art circuit becomes bulky and expensive particularly when the panel to be driven includes many electrodes, e.g., 200 or more, in at least one of the electrode groups. With a conventional driving circuit of the type described above, it has been necessary to compromise between power consumption in the circuit and the speed at which the switching transistors turn off. This compromise has imposed a serious restriction on the progress of the art of plasma display panels and has made it impossible to utilize so-called time division drive to activate a plasma display panel having segmented electrodes for a large number of digits, such as 10 or more digits.

SUMMARY OF THE INVENTION

It is therefore an object of the present invention to provide a circuit having a relatively small number of switching transistors for driving one electrode group of a gas discharge display panel.

It is another object of this invention to provide a driving circuit of the type described, which is operable with a small number of logic circuits.

It is still another object of this invention to provide a driving circuit of the type described, operable at a high speed.

A circuit according to this invention for driving one electorde group of a gas discharge display panel having a pair of electrode groups arranged on opposed sides of gas discharge space includes a positive voltage source, a plurality of PNP transistors, a plurality of NPN transistors, and first means for connecting the emitter electrodes of the PNP transistors to the positive voltage source and second means to connection the emitter electrodes of the NPN transistors to a reference potential. A first plurality of conductors are connected to the collector electrodes of the PNP transistors. A second plurality of conductors are connected to the collector electrodes of the NPN transistors. Each of the second plurality of conductors intersects all of the first plurality of conductors to provide plurality of matrix points. At each of the matrix points, forwardly directed diode means is connected between the first and second conductors. Each electrode of the above-mentioned one group is to be connected to the diode means. The circuit further includes a first plurality of diodes and a second plurality of diodes connected to said first and second plurality of conductors, respectively.

With a driving circuit according to this invention, one electrode group of a gas discharge display panel may be driven either in a time division fashion or selectively in compliance with the desired display. A similar circuit may be used to drive the other electrode group of the display panel.

DESCRIPTION OF THE PREFERRED EMBODIMENT

Figure 1:
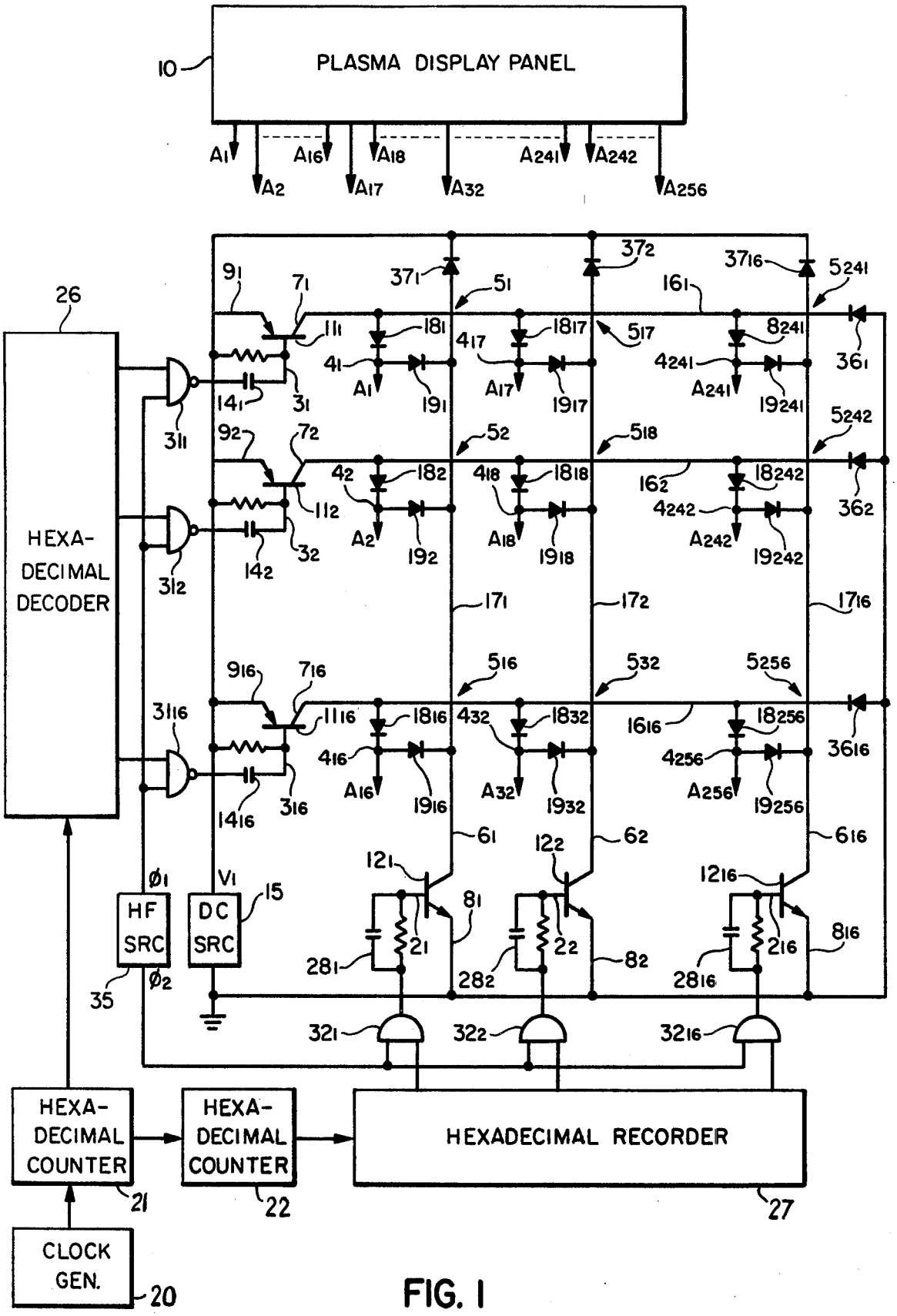
FIG. 1 comprises a schematic block diagram of a gas discharge display driving circuit according to a first embodiment of the instant invention.

Referring to FIG. 1 there is shown, a circuit according to a first embodiment of the present invention for driving one electrode group, comprising 256 electrodes, of a plasma display panel shown as block 10. This plasma display panel includes two electrode groups which are arranged on opposite sides of a gas discharge space as described in the preamble of the instant specification. The circuit comprises 16 PNP transistors $\mathbf{11}_1$, $\mathbf{11}_2$, . . . , and $\mathbf{11}_{16}$ and 16 NPN transistors $\mathbf{12}_1$, $\mathbf{12}_2$, . . . , and $\mathbf{12}_{16}$. For convenience of description, the suffixes of an element group will be omitted hereinafter when the reference numeral or numerals refer to a relevant element or elements in general, rather than to specific one or to ones thereof. The emitter electrodes 9 of the PNP transistors 11 are connected to a source 15 of a positive voltage $V_1$ which voltage is at least equal to the firing voltage of the gas discharge space. The emitter electrodes 8 of the NPN transistors 12 are grounded. Sixteen first conductors 16 are connected to the collector electrodes 7 of the respective PNP transistors 11. Sixteen second conductors 17 are connected to the collector electrodes 6 of the respective NPN transistors 12. Although the first conductors 16 are illustrated parallel to one another while the second conductors 17 are depicted perpendicular to the first conductors 16, it is only necessary that each of the second conductors 17 connect with each of the first conductors 16 to provide 16 matrix points along each second conductor. The first and second conductors 16 and 17 will thus form a total of 256 matrix points 5. At each of the matrix points 5, two forwardly directed series-connected diodes 18 and 19 are connected between the first and second conductors 16 and 17, as is shown in FIG. 1. The 256 junction points 4 of the diodes 18 and 19 are connected to the electrodes of one of the electrode groups of the plasma display panel 10 through wiring (conductor) A.

In order to drive the electrodes of the display panel in a time division fashion, the circuit shown in FIG. 1 further includes a clock generator 20 which generates clock pulses at a repetition frequency which will later be discussed. The clock pulses are supplied to a first hexadecimal counter 21, whose frequency-divided output signal is supplied to a second hexadecimal counter 22. In the manner known in the art, a hexadecimal counter consists of four stages. The four-bit signal derived from the respective stages of the first hexadecimal counter 21 are supplied to a first hexadecimal decoder 26. Similar signals are supplied from the second hexadecimal counter 22 to a second hexadecimal decoder 27. Each hexadicimal decoder 26 or 27 successively energizes its 16 output terminals.

The FIG. 1 circuit also includes 16 NAND gate 31. Each NAND gates 31 has one input which is connected to a different associated output terminal of the decoders 26, and is enabled by the signals supplied from the respective output terminal of the decoder 26. Similarly, 16 AND gates 32 each have one of their input terminals connected to a different associated output terminal of the decoder 27, and are enabled by the signals derived at the respective output terminal of the second hexadecimal decoder 27. A pulse signal source 35 supplies a pair of two-phase pulse trains $\phi_1$ and $\phi_2$ to the second input terminals of the NAND gates 31 and the AND gates 32, respectively. The output terminals of the NAND gates 31 are connected to the base electrodes of the PNP transistors 11 through capacitors 14. The output terminals of the AND gates 32 are likewise connected to the base electrodes 2 of the NPN transistors 12 through shunt resistance-capacitance circuits 28.

The circuit further includes 16 first diodes 36 and 16 second diodes 37. The cathode electrodes of the first diodes 36 are connected to the first conductors 16. The anode electrodes of the second diodes 37 are connected to the second conductors 17. The anode electrodes of the first diodes 36 are grounded. The cathode electrodes of the second diodes 37 are connected to the source 15 of the positive voltage $V_1$.

In operation, it is first assumed for simplicity of description that use is not made of the first and second diodes 36 and 37. It is assumed in addition that the first output terminals of the hexadecimal decoders 26 and 27 are energized. The two-phase pulse trains $\phi_1$ and $\phi_2$ turn the first PNP and NPN transistors $11_1$ and $12_1$ on alternatingly through NAND gates $31_1$ and AND gates $32_1$, respectively. The first conductor $A_1$ will therefore be supplied with a pulse voltage which rises approximately to the positive voltage $V_1$ at every leading edge of each pulse in the first pulse train $\phi_1$ and returns approximately to ground at every leading edge of each pulse in the second pulse train $\phi_2$. The second through sixteenth conductors $A_2$ through $A_{16}$ are kept substantially at ground during this period via the diodes $19_1$–$19_{16}$ and the second conductor $17_1$ which is grounded when the NPN transistor $12_1$ is conducting, and because the diodes 19 prevent the application to these conductors of the positive voltage $V_1$ supplied through the diodes 18 and 19 connected to the first wiring $A_1$ when the PNP transistor $11_1$ is conductive.

The seventeenth, thirty-third, . . . , and two hundred and forty-first display panel conductor $A_{17}$, $A_{33}$, . . . , and $A_{241}$ are kept substantially at the positive voltage $V_1$ by of the first diodes $18_1$, $18_{17}$, $18_{33}$, . . . , $18_{2+1}$ all connected to the first conductor $16_1$ supplied with the positive voltage $V_1$ when the PNP transistor $11_1$ is on, and because the associated first diodes 18 prevent the application to these conductors of ground that is supplied to the first wiring $A_1$ when the NPN transistor $12_1$ conducts. The remaining wiring conductors, such as the two hundred and fifty-sixth wiring $A_{256}$, are not supplied with any definite electric potential. A conductor, such as $A_1$, which is coupled to a matrix point connected to a pair of PNP and NPN transistors which alternatingly conduct is supplied with a pulse voltage V while the remaining wirings such as $A_2$, $A_{17}$, and $A_{256}$ are supplied with no pulse voltage. It is therefore possible with the circuit illustrated to cyclically supply a pulsed voltage V to one electrode group of the plasma display panel 10 and to make the panel 10 display one or more desired numerals, letters, and/or the like by selectively supplying the opposed electrode group with a pulse voltage of the reversed polarity in timed relation to the pulse voltage V.

In connection with the above-discussed operation of the driving circuit, it is necessary to take the following three points into consideration. First to provide a non-flickering display utilizing a time division drive, it is necessary to refresh each electrode of the group involved with a voltage pulse train having a frequency of the order of 50 Hz or more. The repetition frequency of the clock pulses should therefore be 12.8 kHz (50 Hz × 256) or more. Second, to provide a sufficiently bright display, it is necessary to supply each electrode of the relevant group with 2000 or more pulses during each second. The repetition frequency of the pulse train $\phi_1$ or $\phi_2$ should therefore be approximately 500 kHz (2 kHz × 256) or more. It has been confirmed that the embodiment illustrated in FIG. 1 has a switching time of 0.2 microsecond or less for the pulses supplied to the panel electrodes and is stably operable at frequencies as high as 700 kHz.

Third, the pulsed voltage or voltages supplied to one or more electrodes of a gas discharge display panel will induce unwanted electric currents in adjacent electrodes through electrostatic induction or coupling between the electrodes. This will give rise to a spurious display-particularly at those electrodes connected to the conductors to which no definite potential is being supplied. Further, the electrostatic induction or coupling increases the voltage applied across the diodes 18 and 19, which can exceed the diode breakdown voltage. The first and second diodes 36 and 37 clamp the voltages at the electrodes 4 connected to the conductors A to the range from 0 to $V_1$. In other words, the voltages at the electrodes 4 never reach a level lower than the ground potential due to the first diodes 36 and never exceed $V_1$ due to the second diodes 37.

Figure 2:
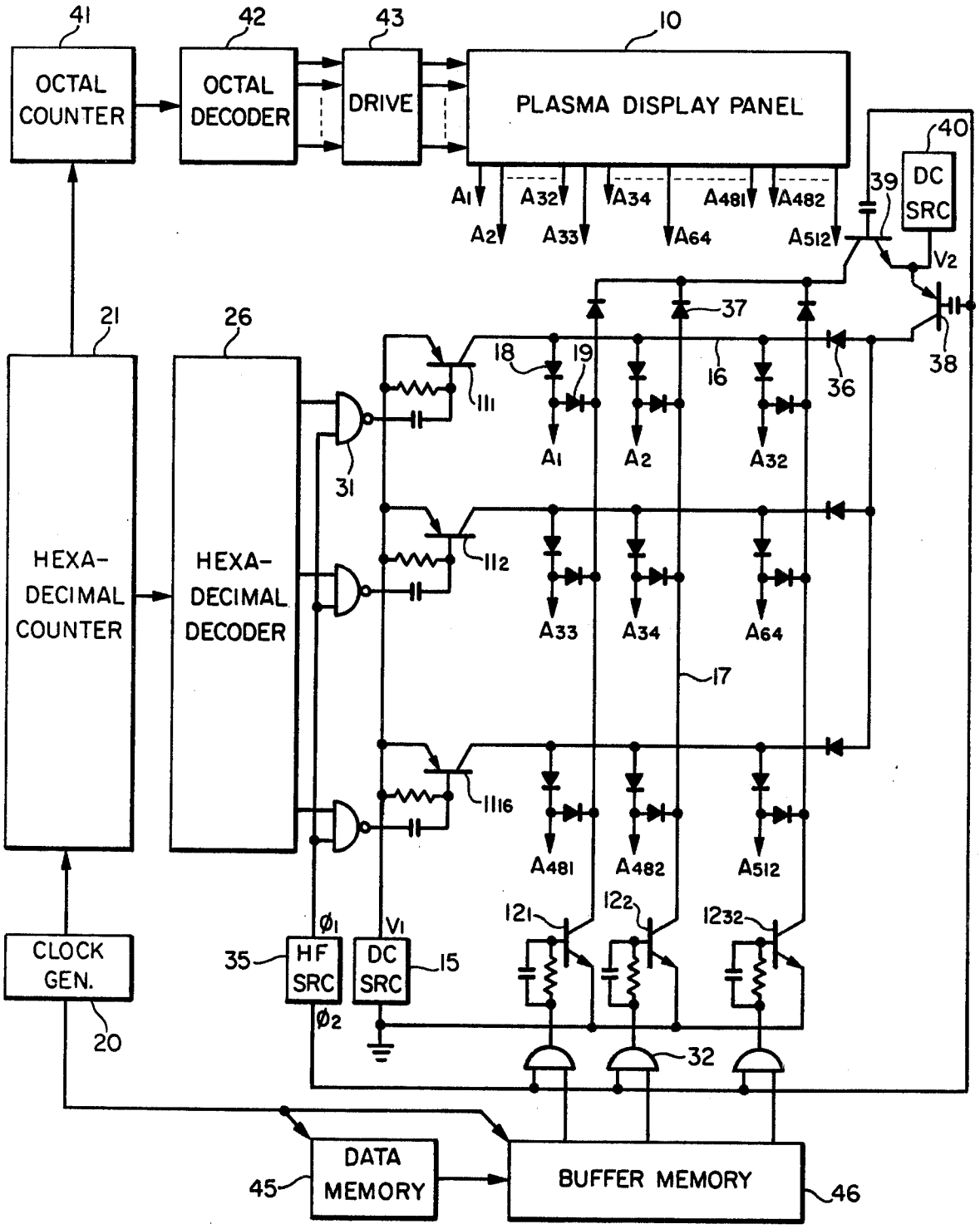
FIG. 2 is a schematic block diagram of a gas discharge display driving circuit according to a second embodiment of this invention.

Referring to FIG. 2, a circuit is shown according to a second embodiment of this invention for driving 512 column electrodes of a plasma display panel 10 having matrix electrodes. Similar elements or parts of the embodiment of FIG. 2 are designated by like reference numerals and letters as employed in FIG. 1. It is assumed here that the panel 10 has eight row electrodes driven in a time division fashion and that the column electrodes are divided into 16 groups, each consisting of 32 electrodes which should selectively be supplied with one or more pulse trains. In the circuit shown in FIG. 2, an octal counter 41 is substituted for the second hexadecimal counter 22 of the circuit of FIG. 1. An octal decoder 42 is supplied with the three-bit signal output of the octal counter 41. A group of driver circuits 43, which may be conventional circuits of this type generate outputs to drive the row electrodes in a time division sequestial fashion in response to the output signals produced by the octal decoder 42. The outputs of decoder 42 cyclically appear on its eight output terminals.

The FIG. 2 circuit further comprises a data memory 45 in which 32-bit binary signals representative of the numerals, letters, and/or the like to be displayed are preliminarily stored either manually or otherwise. A second pulse train is supplied from the clock generator 20 to drive the data memory 45. The memory 45 supplies a 32-bit signal to a buffer memory 46 each time the output of the hexadecimal decoder 26 shifts from one terminal to the next subsequent terminal.

Further, the circuit of FIG. 2 comprises PNP and NPN transistors 38 and 39 whose collector electrodes are connected to the anode electrode of the first diodes 36 and to the cathode electrodes of the second diodes 37, respectively. The emitter electrodes of the transistors 38 and 39 are connected to a source 40 of a positive voltage V2 lower than, e.g., one half of, the voltage $V_1$. The base electrodes of transistors 38 and 39 are supplied with the pulse train $\phi 2$ from the pulse signal source 35 through capacitors. Therefore, when the electrode $\mathbf{4}_1$ is selected, i.e., when the first output terminals of the decoder 26 and the buffer memory 46 are energized, the first conductor $\mathbf{16}_1$ is clamped to $V_1$ by the transistor $\mathbf{11}_1$, the first conductors $\mathbf{16}_2 \ldots \mathbf{16}_{16}$ to $V_2$ by the transistor 38, the second conductor $\mathbf{17}_1$ to the ground potential by the transistor $\mathbf{12}_1$, and the second conductors $\mathbf{17}_2 \ldots \mathbf{17}_{32}$ to V2 by the transistor 39.

What is claimed is:

1. A circuit for driving, by the use of a source of a positive voltage, one electrode group of a gas discharge display panel having a pair of electrode groups on opposite sides of gas discharge space, comprising:

a first plurality of PNP transistors, each having an emitter and a collector electrode;

a second plurality of NPN transistors, each having an emitter and a collector electrode;

first means for connecting the emitter electrodes of said PNP transistors to the positive voltage source and for grounding the emitter electrodes of said NPN transistors;

first conductors, said first plurality in number, connected to the collector electrodes of said PNP transistors;

second conductors, said second plurality in number, connected to the collector electrodes of said NPN transistors, each of said second conductors providing matrix points, said first plurality in number, in cooperation with said first conductors;

forwardly directed diode means each having a predetermined intermediate junction point and connected between said first and second conductors at each of the said matrix points;

second means for connecting the predetermined points to the respective electrodes of said one electrode group;

first diodes, said first plurality in number, connected to said first conductors for clamping the potential of said first conductors to a predetermined potential; and second diodes, said second plurality in number, connected to said second conductors for clamping the potential of said second conductors to a predetermined potential.

2. A circuit for driving an electrode group for a discharge display panel, comprising first and second matrix conductors respectively comprising *i* and *j* elements, wherein *i* and *j* are independent positive integers, a source of first and second potential, *i* first transistor switches each connecting a different one of said first matrix conductor to said first potential supplied by said source thereof, *j* second transistor switches each connecting a different one of said second source thereof, *i·j* pair of series aiding diodes having a junction point therebetween each connecting a different pair of said first and second matrix conductors, said *i·j* diode junction points being adapted for connection to the discharge display panel group electrodes, and time division driver means for sequentially enabling all combinations of one of said first transistor switches and one of said second transistor switches, further comprising *i* clamping diodes each connecting a different one of said *i* first matrix conductors to said second potential supplied by said source thereof, and *j* further clamping diodes each connecting a different one of said *j* second matrix conductors to said first potential.

3. A combination as in claim 2 wherein said time division driver means comprises a clock, a counter including most significant and least significant stages, first diode means connecting said counter least significant stages and said first transistor switches, and second diode means connecting said most significant counter stages and said second transistor switches.

4. A combination as in claim 3 wherein said time division driver means further includes first and second gating means respectively connected between said first and second decoder means and said first and second transistor switches, and plural phase means for alternately enabling said first and second gating means.

* * * * *